US005636393A

United States Patent [19]

Zafiroglu et al.

[11] Patent Number: 5,636,393

[45] Date of Patent: Jun. 10, 1997

[54] MATTRESS COVER WITH INELASTICALLY STRETCHABLE SKIRT

[75] Inventors: Dimitri P. Zafiroglu, Centerville, Del.; Robert H. Hart, Plano; Rhonda R. Boyter, Euless, both of Tex.

[73] Assignee: Pillowtex Corporation, Dallas, Tex.

[21] Appl. No.: 397,328

[22] Filed: Mar. 2, 1995

[51] Int. Cl.[6] ..... A47G 9/04

[52] U.S. Cl. ..... 5/499; 5/498; 5/497; 478/102

[58] Field of Search ..... 5/499, 498, 497, 5/495, 493, 487, 486, 484, 482; 428/102, 232, 293, 294

[56] References Cited

U.S. PATENT DOCUMENTS

| | | |
|---|---|---|
| 22,038 | 11/1858 | Solis . |
| 167,732 | 9/1875 | Blanchard . |
| 249,571 | 11/1881 | Baker . |
| 286,037 | 10/1883 | Mayall . |
| 753,000 | 2/1904 | Phillips . |
| 994,761 | 6/1911 | Laubscher . |
| 1,583,551 | 5/1926 | Heck . |
| 1,620,162 | 3/1927 | Martin . |
| 1,748,743 | 2/1930 | Welder . |
| 1,771,872 | 7/1930 | Brock et al. . |
| 1,825,909 | 10/1931 | Levi . |
| 1,942,111 | 1/1934 | Levi . |
| 2,045,630 | 6/1936 | Bratman . |
| 2,066,428 | 1/1937 | Straus . |
| 2,161,448 | 6/1939 | Bishop . |
| 2,162,755 | 6/1939 | Shauer . |
| 2,183,828 | 12/1939 | Trubitz . |
| 2,195,039 | 3/1940 | Shauer . |
| 2,245,779 | 6/1941 | Heil . |
| 2,266,538 | 12/1941 | Evans . |
| 2,302,259 | 11/1942 | Rothfuss . |
| 2,414,927 | 1/1947 | Chapman . |
| 2,418,347 | 4/1947 | Haag . |
| 2,528,313 | 10/1950 | Kessler . |
| 2,569,627 | 10/1951 | Black . |
| 2,605,483 | 8/1952 | Ridenhour . |
| 2,624,893 | 1/1953 | Harris . |
| 2,639,444 | 5/1953 | DeMonsabert . |
| 2,696,872 | 12/1954 | Kurland et al. . |
| 2,778,412 | 1/1957 | Trubitt . |
| 2,793,683 | 5/1957 | Trubitt . |
| 2,831,445 | 4/1958 | Kuhn . |
| 2,856,615 | 10/1958 | Cirocco . |
| 2,942,280 | 6/1960 | May, Jr. . |
| 3,013,283 | 12/1961 | Steffinich . |
| 3,020,566 | 2/1962 | Anderson et al. . |
| 3,144,666 | 8/1964 | Ragsdale Mazera et al. . |
| 3,150,621 | 9/1964 | Warnock . |
| 3,183,868 | 5/1965 | Shotsky . |
| 3,238,748 | 3/1966 | York et al. . |
| 3,273,175 | 9/1966 | Anderson et al. . |

(List continued on next page.)

FOREIGN PATENT DOCUMENTS

| | | |
|---|---|---|
| 508069 | 12/1954 | Canada . |
| 1051751 | 1/1954 | France . |
| 1450965 | of 1966 | France . |
| 3058-073 | 5/1978 | Japan . |
| 2097-966 | 5/1987 | Japan . |
| 6415279 | of 1966 | Netherlands . |
| 701899 | 1/1954 | United Kingdom . |
| 891355 | of 1962 | United Kingdom . |

OTHER PUBLICATIONS

Perfect Fit Industries Advertisement "Perfect Fit Leads Again!".

*Primary Examiner*—Flemming Saether
*Attorney, Agent, or Firm*—Pennie & Edmonds

[57] ABSTRACT

The invention comprises a mattress cover, mattress cover skirt material and methods of making the same, wherein the skirt material has inelastic stretch in the longitudinal and cross directions and the stretch in the cross direction is considerably greater than the stretch in the longitudinal direction. The mattress cover skirt material also includes a top edge comprised of elastic yarns for providing a reinforced attachment edge and a bottom edge comprised of elastic yarns for pulling the mattress cover skirt material under mattresses.

44 Claims, 2 Drawing Sheets

U.S. PATENT DOCUMENTS 3,290,702 12/1966 Seltzer .
3,316,136 4/1967 Pufahl .
3,336,644 8/1967 Dusenbury et al. .
3,371,668 3/1968 Johnson .
3,468,748 9/1969 Bassett .
3,575,782 4/1971 Hansen .
3,670,345 6/1972 Doll et al. .
3,775,960 12/1973 Ogawa .
3,789,441 2/1974 Weiss .
3,795,019 3/1974 Fragas .
4,042,986 8/1977 Goodman et al. .
4,370,939 2/1983 Carreras Fontcuberta .
4,384,380 5/1983 Glaha et al. .
4,446,189 5/1984 Romanek .
4,552,795 11/1985 Hansen et al. .
4,606,964 8/1986 Widerman .
4,651,370 3/1987 Vitale .
4,657,802 4/1987 Morman .
4,672,702 6/1987 Isham .
4,682,379 7/1987 Dugan .
4,682,555 7/1987 Bierbaum et al. .
4,703,530 11/1987 Gusman .
4,704,321 11/1987 Zafiroglu .
4,707,398 11/1987 Boggs .
4,720,415 1/1988 Vander Wielen et al. .
4,727,608 3/1988 Joyce .
4,734,947 4/1988 Vitale .
4,737,394 4/1988 Zafiroglu .
4,741,949 5/1988 Morman et al. .
4,744,118 5/1988 Lunt .
4,773,238 9/1988 Zafiroglu .
4,781,966 11/1988 Taylor .
4,801,482 1/1989 Goggans et al. .
4,876,128 10/1989 Zafiroglu .
4,879,169 11/1989 Zafiroglu .
4,962,546 10/1990 Vitale .
4,980,941 1/1991 Johnson, III .
4,985,953 1/1991 Seago .
4,998,421 3/1991 Zafiroglu .
5,041,255 8/1991 Zafiroglu .
5,056,441 10/1991 Seago .
5,075,142 12/1991 Zafiroglu .
5,127,115 7/1992 Williams et al. .
5,187,952 2/1993 Zafiroglu .
5,203,186 4/1993 Zafiroglu .
5,247,893 9/1993 Zafiroglu .
5,249,322 10/1993 Seago .

MATTRESS COVER WITH INELASTICALLY STRETCHABLE SKIRT

TECHNICAL FIELD

This invention relates to mattress covers, and particularly to a mattress cover incorporating a stretchable skirt. Moreover, the invention relates to methods of forming a mattress cover with a stretchable skirt.

BACKGROUND OF THE INVENTION

Mattress covers are well known in the art and are used to cover mattresses to prevent or reduce wear and tear, soiling or other damage to the mattress. Mattresses have been manufactured in various thicknesses. For example, the standard mattress is approximately 7–8 inches thick and manufacturers are now making premium mattresses in sizes up to 14½ inches thick. Thus, there is a need to produce mattress covers for fitting mattresses of various sized thicknesses.

U.S. Pat. No. 4,985,953, which is assigned to Louisville Bedding Co., discloses a mattress cover that attempts to solve the problem of fitting mattresses of various thicknesses. The mattress cover includes a top panel and a depending skirt. The depending skirt is formed of a gathered layer of inelastic material with a plurality of spaced-apart, parallel rows of elastic cords stitched throughout the inelastic material. Thus, the material is elastic in the direction of the elastic cords and inelastic in the direction perpendicular thereto.

U.S. Pat. Nos. 5,187,952 and 5,247,893, which issued to D. Zafiroglu and are assigned E. I. DuPont Nemours and Co., are incorporated herein by reference and disclose a fitted mattress pad having an elastic skirt formed from a stitchbonded fabric. The elastic skirt is comprised of a fibrous layer having rows of covered spandex yarns and rows of stretch yarns sewn therein to create a fabric with lanes of different stretchability. This skirt material provides stretchability of 190 percent and 60 percent in the longitudinal direction in the first and second lanes, respectively, and provides 80–90 percent stretchability in the transverse direction.

The prior art also consists of a mattress cover disclosed in U.S. Pat. No. 5,127,115, which is assigned to Pillowtex Corporation and is incorporated herein by reference. This mattress cover is comprised of a non-woven substrate, with polyester and Lycra™ threads knitted into the substrate along the longitudinal direction of the skirt. The Lycra™ threads are knitted in one inch intervals to create a fabric having a striped or banded appearance. The skirt fabric exhibits elastic stretch in the longitudinal direction of approximately 60 percent and inelastic stretch in the transverse direction of approximately 30 percent.

SUMMARY OF THE INVENTION

The present invention is comprised of a mattress cover with a stretchable skirt. More particularly, the invention is a mattress cover incorporating a skirt material having substantially greater stretch in the transverse i.e. cross direction than in the longitudinal direction in both the skirt material as produced and after the material is attached to the mattress cover top panel. Still further, the invention is directed to a skirt that exhibits inelastic stretch in both the longitudinal and cross directions, and has substantially greater stretch in the cross direction than in the longitudinal direction. Inelastic stretch results from mechanical deformation of the yarn network which is free of elastomeric yarns or cords such as spandex or rubber, etc.

Thus, the present invention is a mattress cover with a stretchable skirt that incorporates a non-woven substrate having non-elastic yarns stitched throughout the substrate. Elastic yarns are stitched into a bottom edge of the substrate. As noted above, the skirt material inelastically stretches in a longitudinal direction of the skirt and in a cross direction of the skirt. The longitudinal stretch is up to approximately 50–60 percent and typically less than 30 percent with less than about ½ the stretch being recoverable. The stretch in the cross direction is approximately 100–200 percent, i.e., approximately 3 to 10 times the stretch in the longitudinal direction. The recovery in the cross direction is also less than ½ the stretch.

Thus, the material is characterized in that it does not exhibit elasticity, but has substantial stretchability. This enables the skirt to stretch in the longitudinal direction to fit mattress circumferences, i.e, the mattress sides and ends, and in the cross directions to fit mattresses of varying thicknesses. Preferably, by stitching elastic yarns into the bottom edge, a separate elastic strip is not needed to pull the mattress skirt underneath the mattress. The elastic yarns are stitched into the bottom edge in a width of approximately 1 to 2½ inches, preferably about 2 inches, such that the elastic provides sufficient tension to pull the skirt material under the mattress.

Preferably, the skirt material also includes a strip of elastic yarns stitched into the top edge of the skirt material to provide reinforcement for the attachment of the skirt to the mattress cover top panel. The elastic yarns along the top edge are slightly tensioned when attached to the top panel. This improves the stretchability of the skirt material so that it smoothly fits the mattress it is designed for. Preferably, this top edge is narrower in width than the bottom edge. That is, the top edge is typically less than 1½ inches wide, and preferably less than ½ inch.

Still further, the present invention is directed to a method of forming a mattress cover with a stretchable skirt. More particularly, the invention is directed to a method of forming a mattress cover incorporating a skirt material having inelastic stretch in both the longitudinal and cross directions, and considerably greater stretch in the cross direction than in the longitudinal direction.

The mattress cover is formed by forming the top panel, forming the skirt material and attaching the skirt material to the top panel. The skirt material is formed by stitching inelastic yarns into a non-woven substrate, preferably in a tricot stitch, and stitching elastic yarns into the top and bottom edges of the non-woven substrate to form the skirt material as described above. The skirt material is then attached to the top panel under some tension. Furthermore, the top edge should be formed narrower in width than the bottom edge, and, more particularly, the elastic yarns should be stitched in the top edge such that the top edge is preferably less than 1½ inches and in the bottom edge such that the bottom edge is approximately 1 to 2½ inches.

DETAILED DESCRIPTION OF THE PREFERRED EMBODIMENT

Figure 1:
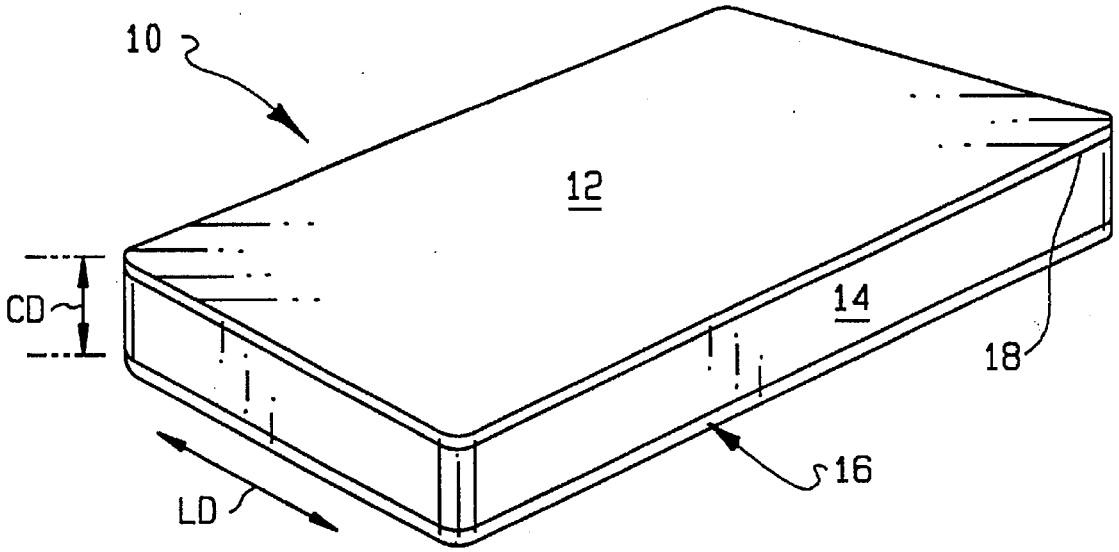
FIG. 1 is a perspective top view of a mattress cover according to the present invention.

Referring to the drawings, FIG. 1 discloses a mattress cover 10 formed of a top panel 12 and a skirt 14. The top panel 12 is preferably a quilted material having padding such that it provides a comfortable pad to lay on and may include a water impermeable layer. The top panel 12 is preferably dimensioned to be approximately the same size as the top of the mattress that it is designed to cover. The skirt 14 is comprised of a stretchable material as described in more detail below.

The skirt 14 is comprised of a material made of non-woven substrate and preferably of polyester fibers. A preferred non-woven substrate is a spunlaced sheet of hydraulically entangled polyester fibers such as Sontara® 8017 by DuPont. This substrate provides little structural stability and, thus, little resistance to the stretch. For structural stability, the substrate has inelastic yarns stitched therein. Preferably such yarns are made of polyester and are stitched in a tricot stitch such that they zig-zag back and forth to form loops with adjacent yarns. The polyester yarns are stitched in the longitudinal direction of the skirt 14 and preferably in 1-0,1-2 tricot stitch or 1-0,2-3 tricot stitch. The polyester yarns provide structural stability to the material and limit the stretchability, i.e., the inelastic elongation of the material. The stitching pattern of the polyester yarns can be changed to provide for different stretch characteristics.

The skirt 14 is a substantially smooth material and has inelastic stretch in both the longitudinal and cross directions. In the longitudinal direction, denoted by LD, the material stretches approximately 30 percent and recovers about ⅓ of this stretch. Thus, the skirt 14 stretches in the longitudinal direction to conform to the circumference of the mattress, i.e., the sides and ends of the mattress, but does not elastically return to its original length.

The material also exhibits stretch in the cross direction, denoted by CD, i.e., across the thickness of the underlying mattress. In the cross direction, the material stretches 100–120 percent and recovers less than ¼ of this stretch. Therefore, the skirt 14 also does not elastically recover to its original width after being stretched in the cross direction.

Thus, the material has stretchability in the cross direction approximately 3 to 4 times the stretchability in the longitudinal direction. This enables the mattress cover 10 to conform to the mattress circumference and, more importantly, to stretch substantially in the cross direction to fit mattresses of various thicknesses.

The skirt 14 further includes elastic yarns stitched into the top and bottom edges. The elastic yarns are preferably nylon-wrapped Lycra™ yarns and are stitched in a chain or tricot stitch to form a bottom edge 16. The bottom edge 16 functions to pull the bottom peripheral edge of the skirt 14 underneath the mattress. Skirt 14 is substantially smooth and flat when put into place to cover mattresses.

In the preferred embodiment, the skirt further includes a top edge 18 which is comprised of elastic yarns stitched into the substrate. The resulting, reinforced top edge 18 provides an attachment location for sewing the skirt to the top panel 12. Again, the elastic yarns are preferably the same nylon wrapped Lycra™ yarns as in the bottom edge and are stitched into the substrate in a chain stitch or a tricot stitch such that the yarns form loops and bind with adjacent yarns to create a stable location for the skirt to be attached to the top panel 12. The elastic yarns along the top edge are slightly tensioned when attached to the top panel. This improves the smooth, flat fit of the skirt 14 around the mattress it is designed for.

Figure 2A:
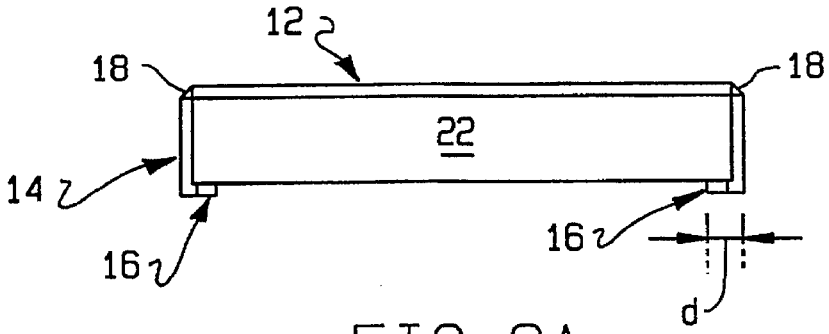
FIG. 2A is a cross-sectional side view of a standard sized mattress and mattress cover according to the present invention.
Figure 2B:
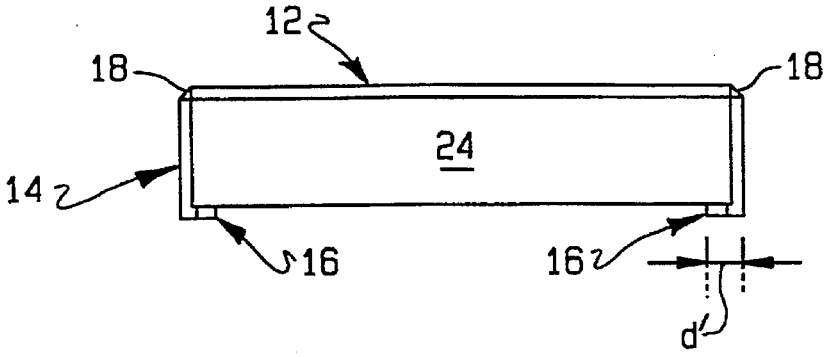
FIG. 2B is a cross-sectional side view of a thick mattress and mattress cover according to the present invention.

Referring now to FIGS. 2A and 2B, the mattress cover 10 is shown over a standard size mattress 22 (7–8 inches thick) and a premium mattress 24 (14½ inches thick). The top panel 12 overlays the top of the mattress and the skirt 14 covers the sides and ends of the mattress 22. The bottom edge 16 pulls the peripheral bottom edge of the skirt material underneath the mattress 22. The top panel 12 is formed to be approximately the size of the top of the mattress 22 and, thus, extends substantially to the peripheral edges of the top of the mattress 22.

The side skirt 14 is formed to substantially cover the sides and ends of the standard mattress without being stretched in the cross direction. For this purpose, the skirt material, before being attached to the top panel, is preferably made approximately 12 inches wide. The skirt material is made a little wider than the mattress thickness because the top edge 18 containing elastic yarns is approximately ½ inch wide, for attaching the skirt 14 to the top panel 12. Also, the bottom edge 16 containing its elastic yarns is approximately 2 inches wide to pull the skirt material under the mattress. Therefore, the inelastic skirt material is approximately 9½ inches wide which will fit mattresses of 7 to 8 inches thick without stretching. Thus, there is not a substantial amount of excess skirt material that is unnecessarily tucked under mattresses of standard thicknesses. Also, the extra inch or so of skirt material allows the consumer to add a mattress cushion (not shown) between the mattress and the mattress cover.

Referring to FIG. 2B, the mattress 10 is now shown on a premium mattress 24 having greater thickness than a standard mattress in the cross direction. Again, the mattress top panel 12 overlays the top of the mattress 24 and the skirt 14 covers the sides and ends of the mattress 24. As with the standard mattress, the bottom edge 16 pulls the skirt material 14 underneath the premium mattress.

Referring back to FIG. 2A, the skirt 14 is not stretched in the cross direction since the material is made of a sufficient width to fit standard size mattresses in an unstretched condition. The skirt 14 extends a distance under the mattress. In contrast, as illustrated in FIG. 2B, the skirt 14 has stretched in the cross direction in order to fit the thicker premium mattress. The skirt 14 extends a similar distance d' under the mattress. Thus, the skirt material can be manufactured to a width such that the skirt will fit a standard mattress without stretch and can be stretched in the cross direction to fit a premium, thicker mattress. As a result, substantial material can be saved as contrasted to making a skirt of a width sufficient to fit thicker premium mattresses. Thus, the invention permits the manufacture of a single mattress cover which will fit mattresses of various thicknesses, from standard to premium mattresses, with a minimum of wasted material.

In addition, because the skirt material of this invention is stretchable, but not elastic, the skirt 14 can be stretched to cover mattresses of thicker widths and yet the skirt 14 will not exhibit an elastic force in the cross direction to pull the elastic band 16 out from under the mattress.

Figure 3:
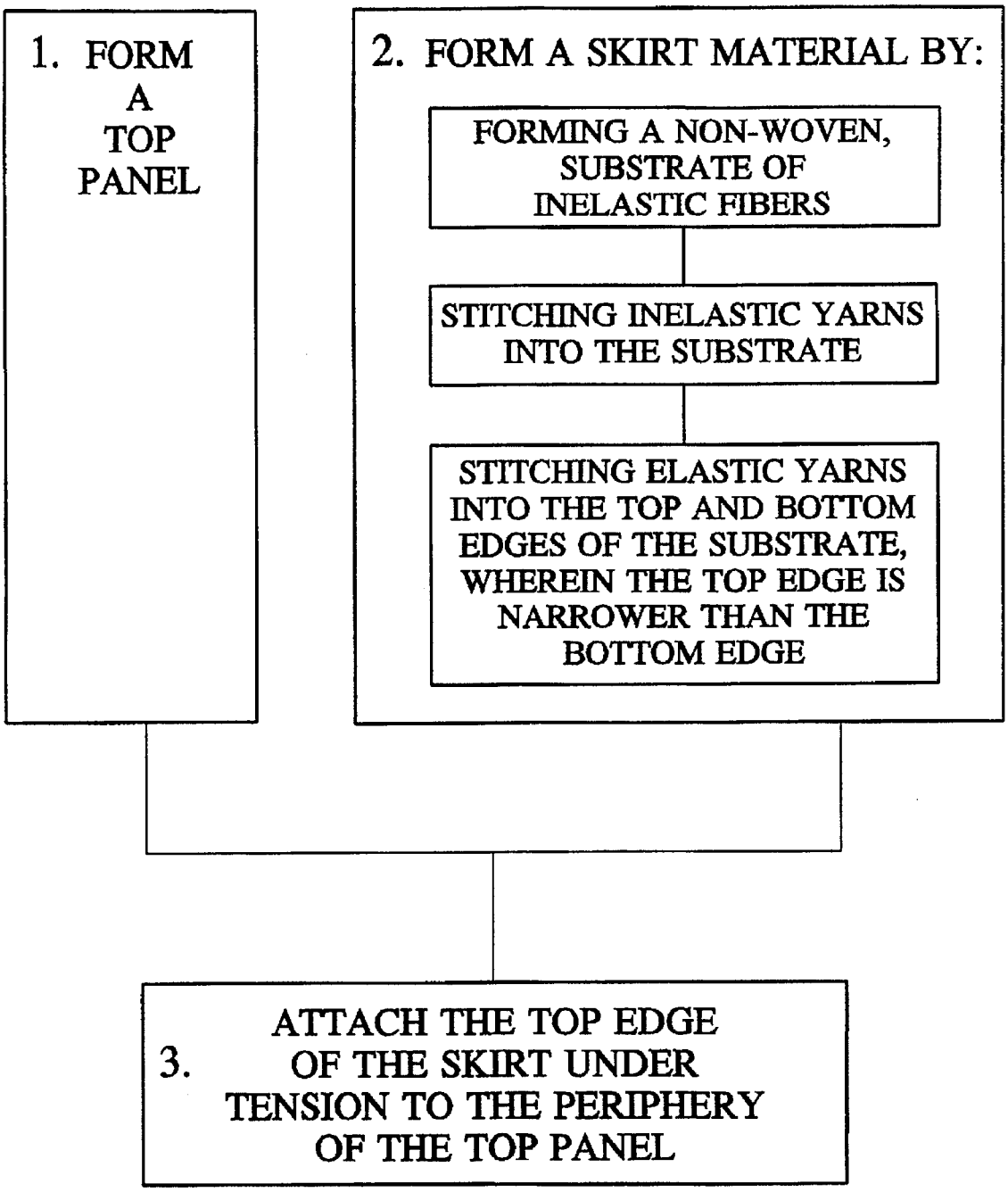
FIG. 3 is a flow diagram of the method of forming a mattress cover having a stretchable side skirt.

FIG. 3 illustrates the basic steps of manufacturing a mattress cover having a stretchable side skirt. This method generally includes the steps of forming a top panel, forming skirt material and attaching the skirt material to the top panel. The top panel is preferably made by quilt stitching two layers of material with filling material therebetween. The top panel is formed or cut such that it substantially corresponds in size to the top of the mattress it is designed to cover.

Skirt material is formed in several steps. First, a non-woven substrate is formed. Preferably, the substrate is formed by hydraulically entangling a plurality of fibers. Then the substrate is loaded onto stitching equipment. Preferably, the stitching equipment has a plurality of rows of needles, each row having needles spaced approximately 1/12 of an inch apart. In the first row of needles, substantially inelastic yarn is threaded into each needle or every other needle. This allows the first row of needles to stitch into the substrate inelastic yarns throughout the substrate width. These yarns are preferably polyester and are stitched into the substrate in a tricot stitch and, more particularly, in a 1-0,1-2 or 1-0,2-3 tricot stitch. Preferably, the inelastic yarns are stitched into the substrate under minimal tension to provide maximum stretch.

In a second row of needles, elastic yarns are threaded into selected needles to form the top and bottom edges such that the top edge is narrower in width than the bottom edge. Preferably, the elastic yarns are stitched into the bottom edge of the substrate under high tension to provide the tension force for pulling the periphery of the skirt under mattresses. Preferably, bare or wrapped spandex yarns are threaded into needles that correspond to the top edge of the skirt material such that approximately a ½ inch width top edge is formed. This can be accomplished by threading about 3 to 6 of the first 6 needles to provide the desired width. Preferably, bare or wrapped spandex yarns are also threaded into the needles that correspond to the bottom edge of the skirt such that the bottom edge is approximately 2 inches wide. This can be accomplished by threading approximately 12 to 24 of the last 24 needles to provide the desired width.

In a preferred method, the stitching machine can be approximately 144 inches wide and a plurality of skirts can be formed simultaneously by stitching yarns into an approximately 144 inch wide substrate and then slitting the substrate to form the respective skirt material of about 12 inches. This material can be rolled so that it can be applied to top panels at a later date. In this embodiment, the inelastic yarns are threaded in needles throughout the width of the machine, but the elastic yarns are threaded only in the needles that correspond to the respective top and bottom edges of the skirts.

After the skirt material and the top panel are formed, the skirt material is attached to the top panel under slight tension such that the skirt material is maintained flat and will fit mattresses smoothly.

While it is apparent that the illustrative embodiment of the invention herein disclosed fulfills the objectives stated above, it will be appreciated that numerous modifications and other embodiments may be devised by those skilled in the art. Therefore, it will be understood that the appended claims are intended to cover all such modifications and embodiments which come within the spirit and scope of the present invention.

We claim:

1. A mattress cover comprising:

a top panel for overlaying the top surface of a mattress; and a skirt attached to a peripheral edge of the top panel for covering the sides and ends of the mattress, wherein said skirt stretches substantially more in a cross direction than in a longitudinal direction is comprised of a non-woven substrate having inelastic yarns stitched therein.

2. The mattress cover of claim 1, wherein the skirt stretches approximately 3 to 10 times more in the cross direction than in the longitudinal direction.

3. The mattress cover of claim 2, wherein the skirt stretches approximately 3 to 4 times more in the cross direction than in the longitudinal direction.

4. The mattress cover of claim 1, further comprising an elastic bottom edge formed of elastic yarns stitched into the skirt along a bottom peripheral edge thereof.

5. The mattress cover of claim 4, further comprising a top edge comprising elastic yarns stitched into a top peripheral edge of the skirt, wherein the skirt is attached to the top panel along the top edge.

6. The mattress cover of claim 5, wherein the top edge is narrower in width than the bottom edge.

7. A mattress cover comprising:

a top panel for overlaying a top surface of a mattress; and a skirt attached to a peripheral edge of the top panel for covering the sides and ends of the mattress, wherein said skirt stretches approximately 100 to 200 percent with less than 50 percent of the stretch being recoverable in a cross direction of the skirt such that the skirt can be inelastically stretched in the cross direction to fit mattresses of various widths.

8. The mattress cover of claim 7, wherein the skirt stretches less than approximately 60 percent in a longitudinal direction of the skirt.

9. The mattress cover of claim 8, wherein the skirt stretches approximately 120 percent in the cross direction.

10. The mattress cover of claim 9, wherein the skirt stretches approximately 30 percent in the longitudinal direction.

11. The mattress cover of claim 10, wherein the skirt is comprised of a non-woven substrate having inelastic yarns stitched therein.

12. The mattress cover of claim 11, further comprising an elastic bottom edge formed of elastic yarns stitched into the skirt along a bottom peripheral edge thereof.

13. The mattress cover of claim 12, further comprising a top edge comprising elastic yarns stitched into a top peripheral edge of the skirt and having a width less than the width of the bottom edge, wherein the skirt is attached to the top panel along the top edge.

14. A mattress cover comprising:

a top panel for overlaying a top surface of a mattress; and a skirt attached to the top panel along a peripheral edge thereof for covering the sides and ends of the mattress, said skirt comprising:

a non-woven substrate;

a plurality of inelastic yarns stitched into the non-woven substrate, such that the skirt has structural stability and exhibits inelastic stretch in a cross direction that is substantially greater than in a longitudinal direction, whereby the skirt can fit mattresses of various thicknesses.

15. The mattress cover of claim 14, wherein the skirt is further comprised of a bottom edge comprised of a plurality of elastic yarns stitched into the skirt material, for pulling a bottom peripheral edge of the skirt under mattresses.

16. The mattress cover of claim 12, wherein said skin is further comprised of a top edge which is comprised of a plurality of elastic yarns stitched into a top peripheral edge of the skirt, said top edge being attached to the top panel.

17. The mattress cover of claim 16, wherein the top edge is less than 1½ inches wide.

18. The mattress cover of claim 17, wherein the top edge is approximately ½ inch wide.

19. The mattress cover of claim 16, wherein the top edge is comprised of a plurality of tensioned elastic yarns when attached to the top panel.

20. The mattress cover of claim 15, wherein the bottom edge is approximately 1 to 2½ inches wide.

21. The mattress cover of claim 20, wherein the bottom edge is approximately 2 inches wide.

22. The mattress cover of claim 14, wherein the skirt stretches approximately 3 to 10 times more in the cross direction than in the longitudinal direction.

23. The mattress cover of claim 22, wherein the skirt stretches approximately 3–4 times more in the cross direction than in the longitudinal direction.

24. The mattress cover of claim 14, wherein the non-woven substrate is comprised of hydraulically entangled polyester fibers and the inelastic yarns stitched therein are polyester yarns.

25. The mattress cover of claim 24, further comprising an elastic bottom edge formed of elastic yarns stitched into the skirt along a bottom peripheral edge thereof.

26. The mattress cover of claim 25, further comprising a top edge comprising elastic yarns stitched into a top peripheral edge of the skirt, wherein the skirt is attached to the top panel along the top edge.

27. The mattress cover of claim 14, wherein the skirt stretches less than approximately 60 percent in a longitudinal direction of the skirt.

28. The mattress cover of claim 27, wherein the skirt stretches approximately 30 percent in the longitudinal direction.

29. The mattress cover of claim 14, wherein the skirt stretches approximately 100 to 200 percent with less than 50 percent recovery in the cross direction.

30. The mattress cover of claim 29, wherein the skirt stretches approximately 120 percent and with less than approximately 25 percent recovery in the cross direction.

31. A mattress cover skirt material comprising:

a non-woven substrate;

a plurality of inelastic yarns stitched into the non-woven substrate, such that the skirt has structural stability and exhibits inelastic stretch in a cross direction and in a longitudinal direction, wherein the stretch is substantially greater in the cross direction than in the longitudinal direction, whereby the skirt can fit mattresses of various thicknesses;

a bottom edge comprised of a plurality of elastic yarns stitched into the skirt material, for pulling a bottom peripheral edge of the skirt material under mattresses.

32. The mattress cover skirt material of claim 31, wherein said skirt is further comprised of a top edge which is comprised of a plurality of elastic yarns stitched into a top peripheral edge of the skirt.

33. The mattress cover skirt material of claim 32, wherein said top edge is narrower in width than the bottom edge.

34. The mattress cover skirt material of claim 33, wherein the top edge is less than approximately 1½ inches wide.

35. The mattress cover skirt material of claim 34, wherein the top edge is approximately ½ inch wide.

36. The mattress cover skirt material of claim 31, wherein the skirt material stretches approximately 3 to 10 times more in the cross direction than in the longitudinal direction.

37. The mattress cover skirt material of claim 36, wherein the skirt material stretches approximately 3–4 times more in the cross direction than in the longitudinal direction.

38. The mattress cover skirt material of claim 31, wherein the non-woven substrate is comprised of hydraulically entangled polyester fibers and the inelastic yarns are polyester.

39. The mattress cover skirt material of claim 31, wherein the skirt material stretches less than 60 percent in the longitudinal direction of the skirt.

40. The mattress cover skirt material of claim 39, wherein the skirt material stretches approximately 30 percent in the longitudinal direction.

41. The mattress cover skirt material of claim 31, wherein the skirt material stretches approximately 100 to 200 percent and recovers less than 50 percent of the stretch in the cross direction.

42. The mattress cover skirt material of claim 41, wherein the skirt material stretches approximately 120 percent and recovers less than approximately 25 percent of the stretch in the cross direction.

43. The mattress cover skirt material of claim 41, wherein the bottom edge is approximately 1 to 2½ inches wide.

44. The mattress cover skirt material of claim 43, wherein the bottom edge is approximately 2 inches wide.

* * * * *